United States Patent [19]

Kameli

[11] Patent Number: 5,024,296

[45] Date of Patent: Jun. 18, 1991

[54] ELEVATOR TRAFFIC "FILTER" SEPARATING OUT SIGNIFICANT TRAFFIC DENSITY DATA

[75] Inventor: Nader Kameli, New Britain, Conn.

[73] Assignee: Otis Elevator Company, Farmington, Conn.

[21] Appl. No.: 580,901

[22] Filed: Sep. 11, 1990

[51] Int. Cl.[5] ..... B66B 1/20

[52] U.S. Cl. ..... 187/132

[58] Field of Search ..... 187/131, 132, 124, 101

[56] References Cited

U.S. PATENT DOCUMENTS 4,838,384 6/1989 Thangavelu ..... 187/124

*Primary Examiner*—J. R. Scott

*Assistant Examiner*—Charles E. Eckholdt

[57] ABSTRACT

A computer based elevator system (FIG. 1) including data "filtering" means evaluating at least part of the system's over-all operational, historic data base, determining when significant traffic density was present in the system and then selecting out such data, saving it in a special data base. Boarding and de-boarding count data is separately processed on a floor-by-floor, time-interval-by-time-interval, sequential basis and evaluated with respect to two base lines (FIGS. 2A and 4)—a first, "end" base line ("E") based on a preset, lower percent of the total floor's population ("F.P."; e.g. E=1% F.P.), and a second, "start" base line ("S") baased on a preset, higher percent of that floor's total population (e.g. S=3% F.P.); and two time frames—a first, minimum time frame ("T.S.") based on the time (e.g. 18 minutes) the values must stay above "S" for significant traffic density to be considered present, and a second, maximum time frame ("T.E.") based on the maximum allowed time the values (which previously met the first percent and time requirements) may go and continuously stay below "E", which, when this time maximum (e.g. 6 minutes) is exceeded, is considered the end of the significant traffic density period for those time intervals. All data that meets those criteria is "filtered" through from the incoming data, producing the blocks of filtered data of FIGS. 3 and 5, representing only that data which had been recorded during significant traffic density conditions.

12 Claims, 4 Drawing Sheets

FIG. 1 ELEVONIC 411 EIGHT CAR GROUP CONFIGURATION
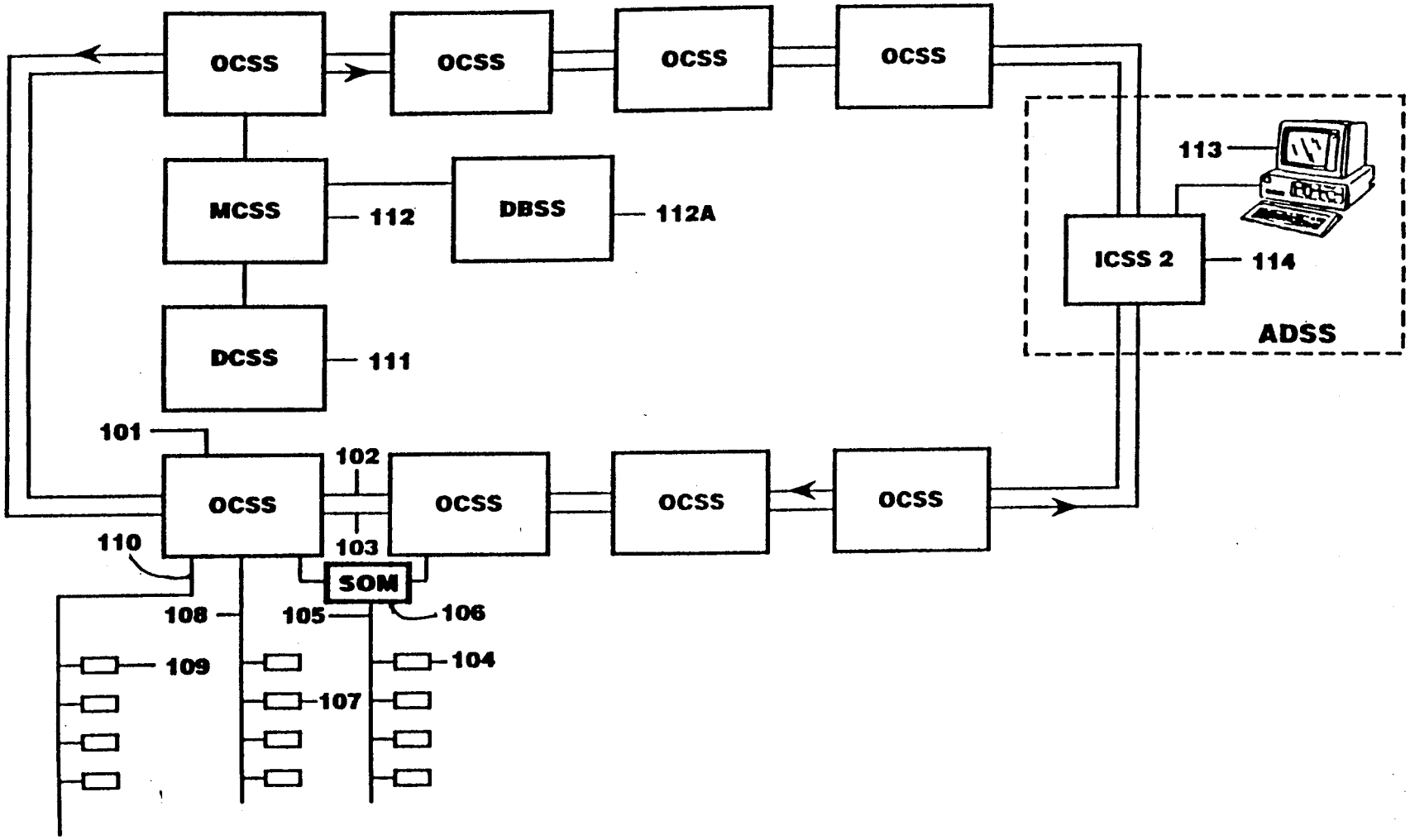

Traffic Data Before Filtering Out Insignificant Data

Traffic Data After Filtering Out Insignificant Data

Traffic Data Before Filtering Out Insignificant Data

Traffic Data After Filtering Out Insignificant Data

ELEVATOR TRAFFIC "FILTER" SEPARATING OUT SIGNIFICANT TRAFFIC DENSITY DATA

DESCRIPTION

Reference to Related Applications

This application relates to some of the same subject matter as the co-pending applications listed below owned by the assignee hereof, the disclosures of which are incorporated herein by reference:

Ser. No. 07/580,888 of the inventor hereof entitled "Behavior Based Cyclic Predictions for an Elevator System with Data Certainty Checks" filed on even data herewith and the applications cited therein including Ser. No. 07/508,312 of the inventor hereof entitled "Elevator Dynamic Channeling Dispatching for Up-Peak Period" filed on Apr. 12, 1990;

Ser. No. 07/508,313 of the inventor hereof entitled "Elevator Dynamic Channeling Dispatching Optimized Based on Car Capacity" filed on Apr. 12, 1990;

Ser. No. 07/508,318 of the inventor hereof entitled "Elevator Dynamic Channeling Dispatching Optimized Based on Population Density of the Channel" filed on Apr. 12, 1990;

Ser. No. 07/580,905 of the inventor hereof entitled "Prediction Correction for Traffic Shifts Based in Part on Population Density" filed on even date herewith; and Ser. No. 07/580,887 of the inventor hereof entitled "Floor Population Detection for an Elevator System" filed on even date herewith.

TECHNICAL FIELD

The present invention relates to elevator systems, and more particularly to elevator systems which record data indicative of actual operating conditions and events in historic data base(es) for use in making predictions of future conditions and events, which predictions can be used, for example, as guides to assign cars to desired locations or roles in the system. Even more particularly, the present invention relates to techniques and methodology for "filtering" such data to separate out for further use that data which occurs during time periods of significant traffic density from that data which does not occur during such system conditions.

BACKGROUND ART

An advanced dispatcher system as used by Otis Elevator Co. is an "artifically intelligent" computer based system that is capable of optimizing the traffic service time for an elevator system typically using various forms of prediction methodology based in part on recorded historic data indicative of past events which have occurred in the elevator system.

One part of this optimization is done by preferably predicting the traffic density for the next time interval for the building. Based on this predication the model will vary the system's set up to better serve the building and/or floor population and decrease the service time.

Thus, preferably, such prediction is done on the intervals in the past few minutes, days or weeks that have shown a significantly high enough traffic to justify the use of the system.

The present invention is directed to the techniques and methodology used to determine when significantly high traffic conditions exist.

DISCLOSURE OF INVENTION

The present invention thus originated from the need to improve elevator service time by more appropriately dispatching cars in the system to handle the traffic needs of the system based on accurate prediction of the future needs of the system when significantly high traffic conditions exist. The present invention is designed to determine when significant traffic density is present.

In general, in considering the "lobby" (or other type of main entry floor) in the preferred algorithm of the invention significant traffic is indicated by the sum of people arriving at the elevator system (the data), so that during the time interval "t" the sum goes over a preset "S" percent of the building population, which serves as an upper, "start" or minimum base line for evaluating the data, and stays above this level for some set minimum period of time "T.S." The end of this "significant traffic" period is noted by the time when the traffic falls below a lower, "end" base line "E" based on a lower or smaller percent of the building's population. With respect to floors other than the lobby, the two base line values ("S" and "E") are based on two different percents of that floor's total population, while the lobby is based on two different percents of the total building population, which in essence is the lobby floor's total population.

"S" and "E" are thus selected so that they create a filtering "window." This prevents the system from creating multiply humps in the traffic pattern, when, for example, the pattern falls below the "S" threshold or upper base line for a relatively short period of time.

Another potential problem with pattern detection of the significant traffic avoided in the present invention is the fact that there might be a fall bellow the "E" line for a short period of time, followed by a rise back to and above the "S" threshold. If this happens, it is not desirable to treat them as two individual episodes in the day, but rather they preferably should be combined to form one continuous trace in considering the presence of significant traffic density. This is done by incorporating a minimum duration on the dropping edge of the trace.

Using this restriction, the trace must fall below the "E" threshold and remain there for a minimum "T.E." period of time to mark the end of significant traffic.

This filter will take care of one other problem systematically to the traffic profiles. There could be traffics of short duration, where the rise will go over the "S" threshold and stay there for only a short period of time and drop down and remain down for longer than "T.E." This would cause that period of traffic to be considered as significant, even though it is not.

To avoid this potential problem, preferably a time restriction is also placed upon the pattern's active period. This restrictions states that in order for the pattern to be recognized as a "significant traffic," it must go over "S" and remain there for a minimum "T.S." period of time. This will cause the "filter" of the invention to remove the patterns that do not cause any significant effect on the performance of the elevator system.

Thus, the present invention is designed to "filter" through and use only the actual values of the parameter detected, while there is significant traffic density present based on boarding and de-boarding counts. Preferably only parameter values which occur during significant traffic density conditions are recorded and maintained in the system's historic data bases, saving storage space and insuring that only significant data is recorded and used in the predicting methodology based on the use of historic data.

The approach of the invention provide better service for the elevator system than would otherwise have been achieved by cars being assigned without the benefit of "significant traffic" considerations.

Thus, stated in other terms, traffic pattern is taken into consideration in the present invention and is considered to be, for example, a bunching of traffic data intervals based on the following criteria.

The start of the pattern is dictated by the detection of a selected number of consecutive intervals of data with the accumulated traffic density exceeding, e.g., three (3%) percent of the building population.

Once the pattern is started, it may typically be terminated by at least the following situation (as discussed in detail below):

(1) if the traffic drops below, e.g., one (1%) percent of the building population and remains low for a selected number of consecutive intervals.

Additionally, particularly if memory is limited in the computer system to be used in implementing the invention and if the filtered through data is being stored in memory as the data is being processed, a further situation which would terminate the pattern would be:

(2) if the duration of the pattern exceeds a predefined, relatively large number of intervals.

However, in the exemplary approach of the preferred embodiment, this latter, potential problem is avoided.

At the end of the day, patterns are detected to join the respective weekly and daily pattern files. Should any data fall outside of any pattern, it may be considered unimportant and may be ignored.

Based on the patterns detected, one (1) set of flags will be created. This set consists one (1) individual flag for each individual interval in the day. For every interval that is part of a pattern, its corresponding flag will be set, and every interval that is not part of a pattern will have its flag in the reset position. These flags create a flag map, which is saved in correspondence to the day in which it is created.

The invention may be practiced in a wide variety of elevator systems, utilizing known technology, in the light of the teachings of the invention, which are discussed above and below in some further detail.

Other features and advantages will be apparent from the specification and claims and from the accompanying drawings, which illustrate an exemplary embodiment of the invention.

BRIEF DESCRIPTION OF DRAWINGS

FIG. 1 is a simplified, schematic block diagram of an exemplary ring communication system for elevator group control employed in connection with the elevator car elements of an elevator system and in which the invention may be implemented in connection with the advanced dispatcher subsystem (ADSS) and the cars' individual operational control subsystems (OCSS) and their related subsystems.

FIG. 2 is a graphical representation of a stream of exemplary de-boarding count data, which had originally come from the OCSSs to the ADSS of FIG. 1 before being recorded in a historic data base in the ADDS, in which the exemplary traffic parameter values ("y" coordinant; e.g. de-boarding or boarding counts) are graphed against a time line ("x" coordinant); while

FIG. 4 is a graphical representation similar to that of FIG. 2 but of a more complex part of an additional stream of exemplary deboarding count data, in which all of the illustrated data stream is filtered though (as shown in FIG. 5) in spite of it falling below the "E" base line, because it did so only for a relatively short period of time, less than T.E., before going back above "E", and in which the two exemplary base lines for the exemplary filtering of the invention are included in dashed lines; while

BEST MODE

First Exemplary Elevator Application

For the purposes of detailing a first, exemplary elevator system, reference is had to the disclosures of U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. application Ser. No. 07/318,307 of Kandasamy Thangavelu entitled "Relative System Response Elevator Dispatcher System Using'Artificial Intelligence' to Vary Bonuses and Penalties" (filed Mar. 3, 1989), as well as of the commonly owned U.S. Pat. No. 4,330,836 entitled "Elevator Cab Load Measuring System" of Donofrio & Games issued May 18, 1982, the disclosures of which are incorporated herein by reference.

Figure 2A:
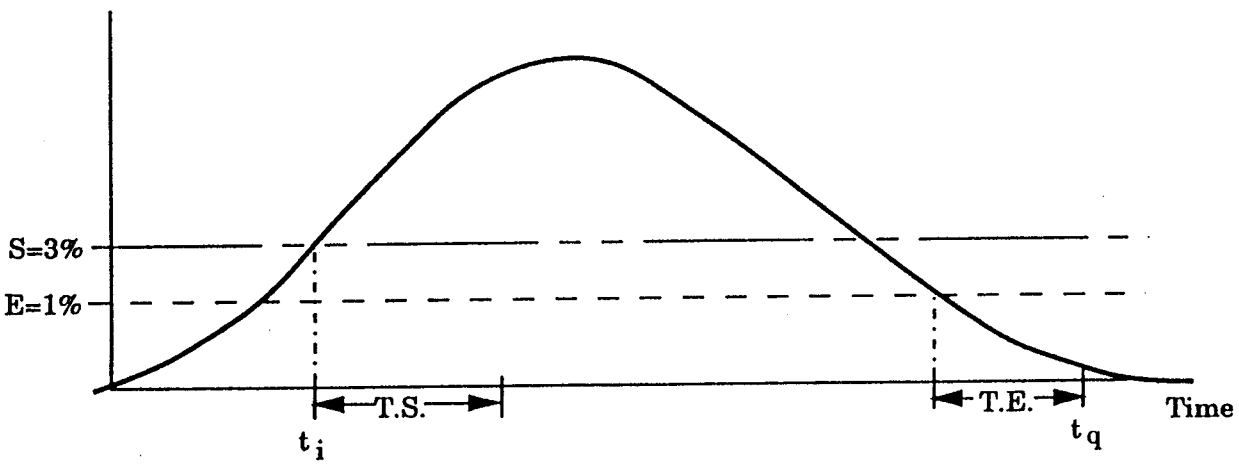
FIG. 2A is a close-up view of an exemplary part (A) of the data stream of FIG. 2, with the two exemplary base lines "S" and "E" for the exemplary "filtering" of the invention being included in horizontal dashed lines, along with indications of the preset minimum time (T.S.) for significant traffic density to be considered present and the preset maximum time (T.E.) for determining the end of the data block to be included in the data to be filtered through, namely that exemplary part (A) of the data stream of FIG. 2 which fulfills the exemplary "significant traffic density" filtering pre-conditions of the invention.
Figure 2:
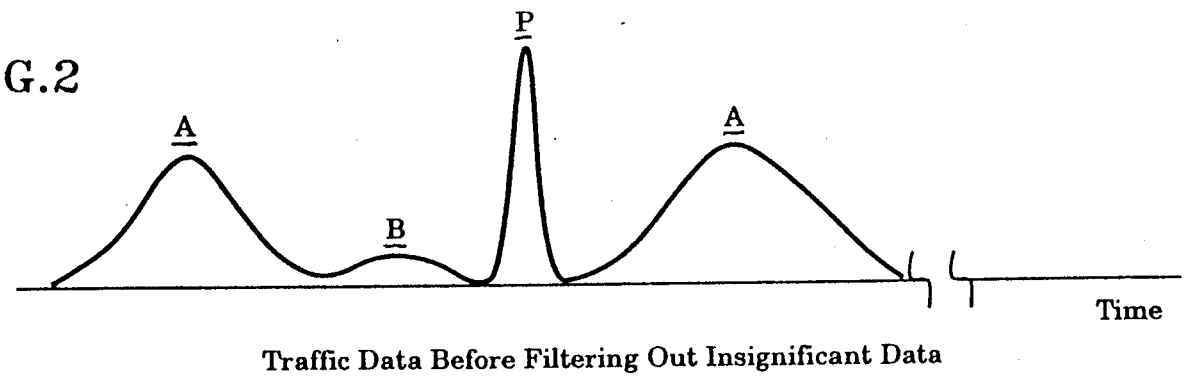

One application for the present invention is in an elevator control system employing microprocessor-based group and car controllers using signal processing means, which through generated signals communicates with the cars of the elevator system to determine the conditions of the cars and responds to, for example, hall calls registered at a plurality of landings in the building serviced by the cars under the control of the group and car controllers, to provide, for example, assignments of the hall calls to the cars. An exemplary elevator system with an exemplary group controller and associated car controllers (in block diagram form) are illustrated in FIGS. 1 and 2, respectively, of the '381 patent and described in detail therein.

The makeup of micro-computer systems, such as may be used in the implementation of the elevator car controllers, the group controller, and the cab controllers can be selected from readily available components or families thereof, in accordance with known technology as described in various commercial and technical publications. The micro-computer for the group controller typically will have appropriate input and output (I/O) channels, an appropriate address, data & control buss and sufficient random access memory (RAM) and appropriate read-only memory (ROM), as well as other associated circuitry, as is well known to those of skill in the art. The software structures for implementing the present invention, and the peripheral features which are disclosed herein, may be organized in a wide variety of fashions.

Additionally, for further example, the invention could be implemented in connection with the advanced dispatcher subsystem (ADSS) and the operational control subsystems (OCSSs) and their related subsystems of the ring communication system of FIG. 1 hereof as described below.

Exemplary Ring System (FIG. 1)

As a variant to the group controller elements of the system generally described above and as a more current application, in certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed to separate microprocessors, one per car. These microprocessors, known as operational control subsystems (OCSS) 101, are all connected together in a two-way ring communication (102, 103). Each OCSS 101 has a number of other subsystems and signaling devices, etc., associated with it, as will be described more fully below, but basically only one such collection of subsystems and signaling devices is illustrated in FIG. 1 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. This load in turn is sent to the OCSS 101. DCSS 111 and MCSS 112 are micro-processors controlling door operation and car motion under the control of the OCSS 101, with the MCSS 112 working in conjunction with the drive & brake subsystem (DBSS) 112A.

The dispatching function is executed by the OCSS 101, under the control of the advanced dispatcher subsystem (ADSS) 113, which communicates with the OCSS 101 via the information control subsystem (ICSS) 114. The car load measured may be converted into boarding and de-boarding passenger counts by the MCSS 112 and sent to the OCSS 101. The OCSS sends this data to the ADSS 113 via ICSS 114.

The ADSS 113 through signal processing inter alia collects the passenger boarding and de-boarding counts at the various floors and car arrival and departure counts, so that, in accordance with its programming, it can analyze the traffic conditions at each floor, as described below. The ADSS 113 can also collect other data for use in making various other predictions for other uses, if so desired.

For further background information reference is also had to the magazine article entitled "Intelligent Elevator Dispatching Systems" of Nader Kameli & Kandasamy Thangavelu (*AI Expert, Sept.* 1989; pp. 32–37), the disclosure of which is also incorporated herein by reference.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicates for each car the car's load.

Using such data and correlating it with the time of day and the day of the week, a meaningful traffic measure can be obtained for determining and evaluating boarding and de-boarding counts for the presence of significant traffic density by using signal processing routines that implement the sequences described in, for example, the flow chart of FIG. 6, described more fully below.

Exemplary Parameter Values and the Filtering Thereof (FIGS. 2–5)

As generally discussed above, the present invention is designed to "filter" out and use only the actual values of the parameters (e.g. boarding and de-boarding counts in the "up" direction, and boarding and de-boarding counts in the "down" direction) being considered while there is significant traffic density present. For example, if desired, only parameter values which occur during significant traffic density conditions could be recorded and maintained in the system's historic data bases, saving storage space and insuring that only data during significant traffic density conditions is recorded and used in the predicting methodology based on the use of historic data.

In the invention the boarding and de-boarding count data is separately processed on a floor-by-floor and a time-interval-by-time-interval, sequential basis. In the exemplary algorithm of the invention the varying values for each parameter for each floor are evaluated over time and are evaluated with respect to two base lines (note FIGS. 2A and 4):

- a first, lower, "end" base line ("E") based, for example, on a preset, lower percent of the total floor population ("F.P."; e.g. E=1% F.P.), and
- a second, higher, "start" base line ("S") based, for example, on a preset, higher percent of that floor's total population (e.g. S=3% F.P.); and two time frames:

- a first, minimum time frame or value ("T.S.") based, for example, on the minimum amount of time [e.g. eighteen (18) minutes] the values of the counts must stay above the upper base line "S" and, when this time frame or value is exceeded, significant traffic density is considered to be present, and a second, maximum allowed time frame or value ("T.E.") based, for example, on the maximum allowed amount of time [e.g. six (6) minutes] the values of the counts which previously met the first percent and time requirements may go below and stay below the lower base line "E", which, when this time maximum is exceeded, is considered in the preferred embodiment to be the end of the significant traffic density period for those time intervals.

Figure 3:
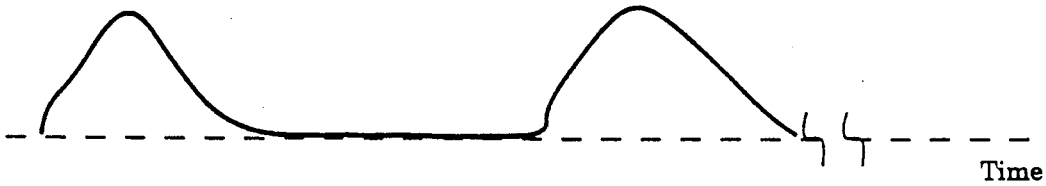
FIG. 3 is a graphical representation similar in format to FIG. 2 but only including the data fulfilling the "significant traffic density" pre-conditions of the invention, i.e. the filtered through data.

All data that meets those criteria is allowed to be filtered through in blocks from the incoming stream of recorded data for those qualifying intervals, producing the blocks of filtered data of FIG. 3, representing only that data which had been recorded during significant traffic density conditions.

Thus, when, for example, the value of the parameter being considered exceeds the higher percentage or value level "S" and thereafter continues to exceed the base line "S" for a minimum preset period of time ["T.S."; e.g. eighteen (18) minutes], significant traffic density is considered to be present. Exemplary, relatively simple traces that fulfill this requirement are traces "A" in FIG. 2.

Figure 4:
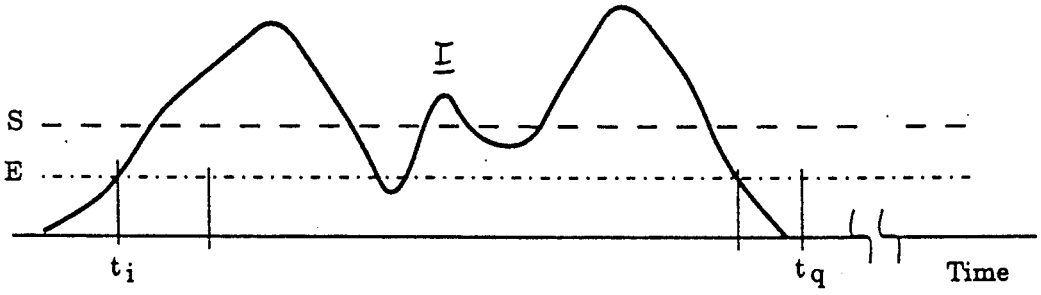
Figure 5:
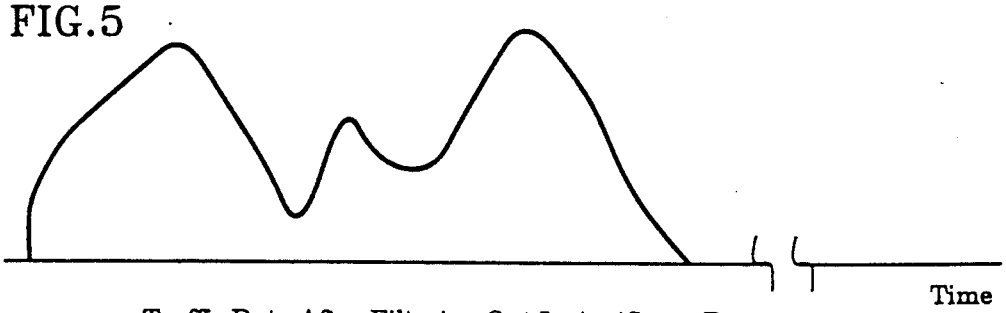
FIG. 5 is a graphical representation similar in format to FIG. 4 including the data fulfilling the "significant traffic density" pre-conditions of the invention, i.e. the filtered through data, which in this example is all of the data of FIG. 4.

For further example, when the parameter data values for the boarding counts for the lobby and the de-boarding counts for the other floors (or alternatively the de-boarding counts for the lobby and the boarding counts for the other floors), which came into the ADDS microcomputer 113 from the various OCSSs 101, are like the exemplary data stream values shown in FIG. 4, when the exemplary "filtering" algorithm of the invention is used in the program resident in the computer 113, the filtered data filtered through is that shown in FIG. 5, which is all of the data in one continuous block even though some of the data values went below the lower base line "E" for a relatively short period(s) of time (note interim trace "I" in the center of the data trace of FIG. 4).

On the other hand, relatively quickly rising and falling data peaks, such as "P" in FIG. 2, do not pass through the "filter" and are not contained in the remaining, filtered through data of FIG. 3. Likewise, data stream values which never exceed the upper base line value "S", such as those at "B", do not pass through the "filter" and are not contained in the remaining, filtered through data of FIG. 3.

Such data "filtering" preferably is done for each floor for both boarding and de-boarding counts. Each floor's population can be provided as set values entered into the system based on, for example, manually acquired data, or, more preferably, each floor's total population can be continually computed by the elevator system and stored in the system's historic data base or in a special file using, for example, the methodology of application Ser. No. 07/580,887 entitled "Floor Population Detection for an Elevator System" referred to above.

Exemplary values for a typically high rise office building of, for example, sixteen (16) stories would be a floor population of one hundred and twenty (120) for each floor above the lobby, with the total building population (floor population for the "lobby") being one thousand, eight hundred (1,800; 120*15). Thus, exemplary values of "E" and "S" are "1.2" (1%) and "3.6" (3%), respectively, for an upper floor. Thus, for example, when a time interval includes four (4) or more passengers boarding (or de-boarding, depending on which is being evaluated), it will be above the "start" threshold "S", and, when an interval has one or no passengers boarding (or de-boarding), it will be below the "end" threshold "E". The corresponding values for the typical lobby would be fifty-five (55) and seventeen (17) passengers for "S" and "E", respectively. These exemplary figures are, of course, subject to great variation.

In general in considering the "lobby" (or other main entry floor) as the floor under consideration, it is noted that typically the floor population of the lobby effectively is the total building population (unless more than one entry level or floor is provided). This figure can serve as a cross-check with respect to the total of all of the other floors' populations.

It is further noted that two different base lines "S" and "E" are preferably used in order to prevent the exclusion of data from the filtered output, which would result from, for example, a relatively quick decrease and then return of the values of the data with respect to a single base line (e.g. "S"), assuming only one reference base line or threshold value was used in the filtering. Exemplary data of this type is shown in phantom line in FIG. 2A.

Figure 6:
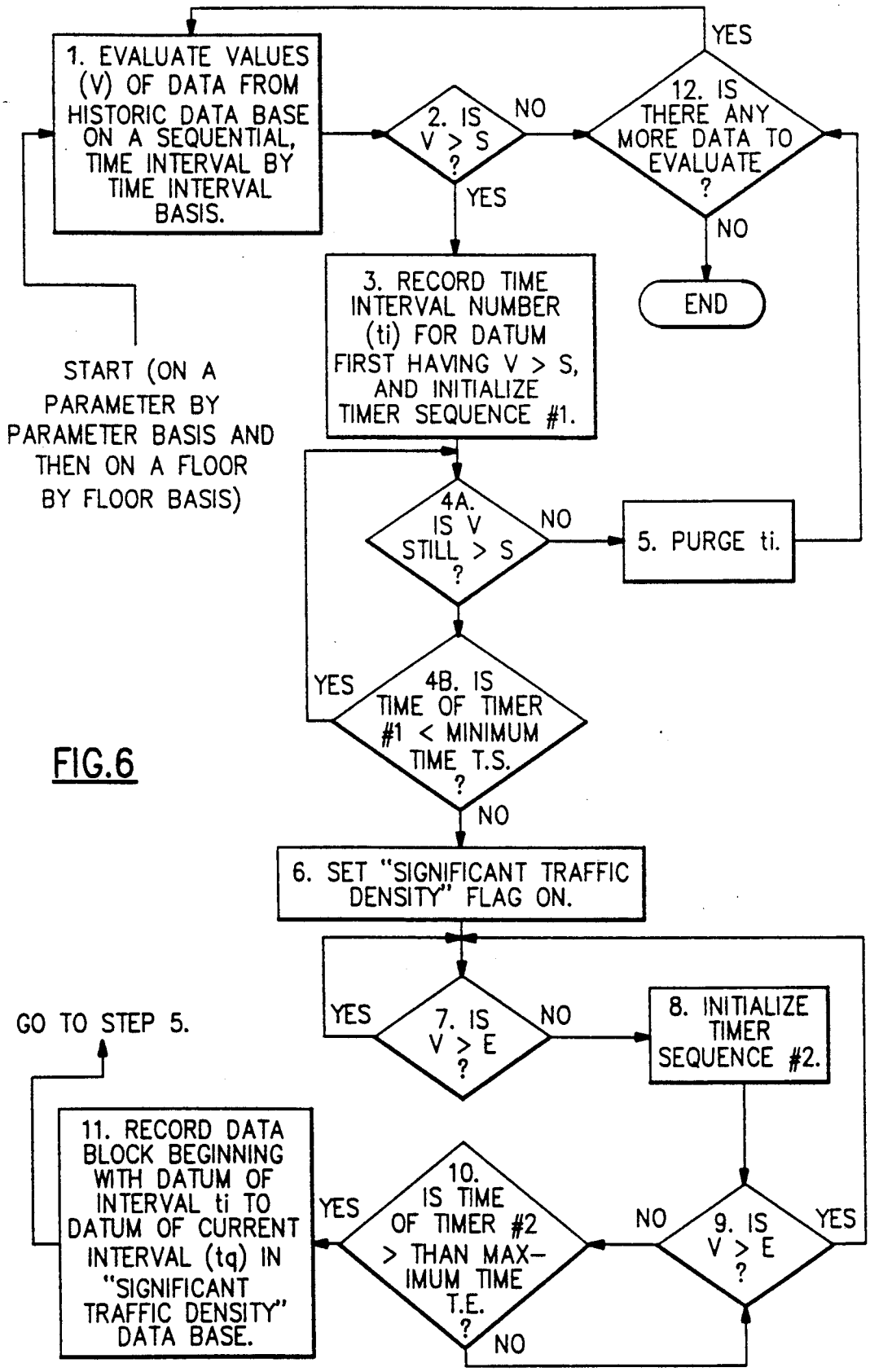
FIG. 6 is a simplified, logic flow chart or diagram of an exemplary algorithm for the methodology used in separating out the "significant traffic density" data in accordance with the invention.

Exemplary Algorithm for Significant Traffic Density Filtering (FIG. 6)

As generally illustrated in FIG. 6, the exemplary logic of the present invention includes the following sequences.

In step 1 the stream of data which has been recorded in the file system on the microcomputer's hard disk, including, for example, the combined de-boarding counts for each interval "t" at floor "F", is evaluated. In step 2, when the value "V" (e.g.V>S) of the data exceeds the upper, "start" threshold value "S" (e.g., 3% of that floor's total population), in step 3 the time interval ($t_i$) for that "start" value is noted or stored in a file or a buffer and maintained there on an interim basis and a timer is initialized.

If "V" stays above "S" for at least the minimum threshold time "T.S.", then the starting time interval ($t_i$) continues to be maintained in steps 4A and 4B. On the other hand, if "V" falls below the lower, "end" threshold base line "E" in less than "T.S." time, in step 5 the interim start time interval ($t_i$) recorded in step 3 is purged or erased, and the sequence returns to step 1 if there is any remaining data to be evaluated (step 12).

In step 6, assuming that the "T.S." condition had been meet for the sequence of time intervals being evaluated, the "significant traffic density" flag is set "ON". In steps 7–10, when "V" drops below "E" and stays down there for more than the maximum allowed time "T.E.", the significant traffic density for the past intervals since step 2 is considered to be over or ended, and the time interval ($t_q$) for the data being evaluated at that point is noted. In step 11 all of the data from the historic data file being reviewed between and including the time intervals "$t_i$" and "$t_q$" is written to and recorded in a historic data base file maintained on, for example, the hard disk in the ADDS microcomputer 113 in the file maintained there for recording significant traffic density pattern data.

The "$t_i$" data from step 3 for the recorded pattern is then purged, and the sequence returns to step 1 [as long as there is data still to be processed (step 12)] to await the next occurrence of the value of the data stream exceeding "S", and the foregoing sequences of step 2+ are repeated until all of the data has been evaluated and all of the resulting blocks of significant traffic density data have been written to its respective file.

All of this data evaluation for the significant traffic density data is processed by the ADDS's computer 113 preferably during an inactive period for cars of the elevator system, such as late at night (e.g. 11:30 PM) or very early in the morning (e.g. 1:30 AM), in conjunction with the various signal and data processing for performing the system's prediction methodology for the next day's events and operation, the system's diagnostics, etc. Indeed the historic significant traffic density data is used as part of, for example, the channeling operation described in application Ser. No. 07/508,312 entitled "Elevator Dynamic Channeling Dispatching for Up-Peak Period"; note also applications Ser. No. 07/508,313 and 07/508,318 entitled "Elevator Dynamic Channeling Dispatching Optimized Based on Car Capacity" and "Elevator Dynamic Channeling Dispatching Optimized Based on Population Density of the Channel", all referred to above. It also can be used in association with the subsystem disclosed in Ser. No. 07/580,905 entitled "Prediction Correction for Traffic Shifts Based in Part on Population Density" also referred to above.

If desired, further evaluation of the data value trace after the significant traffic density data crosses below the lower, "end" line "E" could be implemented to "fine tune" whether any or all of the below "E" values should be excluded from the significant traffic density pattern data to be recorded in its historic data base. However, the above described sequence, which includes all of the below "E" data up to "T.E." in the pattern data, is acceptable and preferred for its simplicity.

Although this invention has been shown and described with respect to at least one detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. An elevator subsystem for use in association with a computer based elevator system having clock timing means and a historic data base, which data base includes at least passenger traffic indicative data, such as boarding and de-boarding counts for at least the past day maintained on a time-interval-by-time-interval, sequential basis, for processing the elevator passenger traffic data for use in the elevator system, comprising:

data "filtering" signal processing means for receiving and evaluating incoming elevator passenger traffic data having at least two, preset elevator passenger traffic values, one greater than the other, indicative of two different levels of passenger traffic, and at least two, preset time values, a first, minimum time value based on a minimum amount of time the incoming data must continuously have values great than said preset, greater traffic value, traffic data values fulfilling these conditions being indicative of significant traffic density in the elevator system, and a second, maximum time value based on the amount of time the incoming data remains below the lesser of said preset traffic values, after having remained above said minimum, greater traffic value for at least said minimum time value, said data "filtering" means generating signals indicative of what part of the traffic data first exceeded said greater preset traffic value when the values of the data continued to be greater than said greater preset traffic value for at least said preset minimum time value, fulfilling a first condition, and indicative of what part of the traffic data thereafter had values below the lesser preset traffic value for a period of time exceeding said present maximum time value, said signals be usable to cause at least a substantial part of the traffic data existing in the incoming data stream for those intervals whose data fulfilled said conditions to be recorded for further use in the elevator system.

2. The elevator subsystem of claim 1, wherein:

said "filtering" means effectively excludes data which has values greater than said greater preset traffic value but is relatively short in time duration, being less than said time minimum value.

3. The elevator subsystem of claim 1, wherein:

said "filtering" signal processing means effectively includes data, which previously had values greater than said greater preset traffic value, but then dropped below said lesser traffic value but turned back above said greater preset traffic value within said maximum time value.

4. The elevator subsystem of claim 1, wherein:

said two, preset elevator passenger traffic values is based on a minor percent of the floor's population.

5. The elevator subsystem of claim 4, wherein:

said two, preset elevator passenger traffic values are about three (3%) percent and about one (1%) percent, respectively.

6. The elevator subsystem of claim 1, wherein:

said two, preset time values is about eighteen (18) minutes and about six (6) minutes, respectively.

7. A method of processing past, time interval related, elevator passenger traffic data in a computer based elevator system to produce significant traffic density data, comprising the following steps:

(a) reviewing on a time related, sequential basis the elevator passenger traffic related data in the form of a sequential stream of time interval related data;

(b) comparing the traffic related values of the traffic related data to a first, preset, traffic related value and noting the time and the time interval involved when the data value crosses said first, preset, traffic related value and when the traffic data values continuously remain above said first, preset value for a minimum, preset period of time, with said first, preset, traffic related value and said minimum, preset period of time indicating that significant traffic density is present;

(c) subsequently comparing at least some of the subsequent values of the traffic related data to a second, preset, traffic related value lower in value than said first, preset value, and noting at least the time involved when the traffic data value crosses below said second, preset, lower value; and (d) recording into a data file at least the time interval part of some of the traffic data in a time interval related, sequential manner of that part of the traffic data stream between the time when the traffic data values crossed said first, preset value and continuously remained above said first, preset value for said minimum, preset period of time to at least when the traffic data values crossed below said second, lower, preset value and excluding from said data file at least some of the other sequential parts of the traffic data stream, producing a data file having significant traffic density related data.

8. The method of claim 7, wherein there is further included the step of:

recording into said data file additional amounts of sequential traffic data to that previously recorded for as long as the traffic related data values which had previously been above said first, preset value remain below said second, lower preset value for a preset, maximum amount of time.

9. The method of claim 8, wherein there is further included the step of:

excluding from said data file the sequential part of the traffic data after said preset maximum amount of time is exceeded up to at least the time when the traffic data value again crosses said first, preset value.

10. The method of claim 8, wherein there is further included the step of:

including in said data file the sequential part of the traffic data which had values greater than said greater, preset traffic related value, then dropped below said lesser, preset traffic value but turned back above said greater preset traffic value within said preset maximum amount of time.

11. The method of claim 7, wherein there is further included the step of:

excluding from said data file the sequential part of the traffic data which had values greater than said greater, preset traffic related value but which stays above said greater value only a relatively short period of time, less than said preset minimum amount of time.

12. The method of claim 7, wherein there is further included the step of:

presetting said greater and said lesser traffic values based on a minor percent of the floor's population for the traffic data being considered.

* * * * *